US006276156B1

(12) United States Patent
da Silva et al.

(10) Patent No.: US 6,276,156 B1
(45) Date of Patent: Aug. 21, 2001

(54) AIR DIRECTING ASSEMBLY FOR A ROOM AIR CONDITIONER

(75) Inventors: Regis Batista da Silva; Rogerio Soares Brisola, both of Sao Leopoldo (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/367,585

(22) PCT Filed: Dec. 30, 1997

(86) PCT No.: PCT/BR97/00076

§ 371 Date: Aug. 17, 1999

§ 102(e) Date: Aug. 17, 1999

(87) PCT Pub. No.: WO99/35447

PCT Pub. Date: Jul. 15, 1999

(51) Int. Cl.[7] ..... F25D 23/12
(52) U.S. Cl. ..... 62/262; 62/298
(58) Field of Search ..... 62/262, 298, 426

(56) References Cited

U.S. PATENT DOCUMENTS

| | | | | |
|---|---|---|---|---|
| 4,683,370 | * | 7/1987 | Petersen et al. | 219/370 |
| 4,800,734 | | 1/1989 | Sauber et al. | 62/263 |
| 5,085,057 | | 2/1992 | Thompson et al. | 62/262 |
| 5,222,374 | * | 6/1993 | Thompson et al. | 62/262 |
| 5,295,531 | | 3/1994 | Tsunekawa et al. | 165/48.1 |
| 5,638,693 | | 6/1997 | Baek | 62/262 |
| 5,943,873 | * | 8/1999 | Chung | 62/262 |

FOREIGN PATENT DOCUMENTS

| | | | | |
|---|---|---|---|---|
| 54-51236 | * | 4/1979 | (JP) | 62/262 |

* cited by examiner

*Primary Examiner*—Henry Bennett
*Assistant Examiner*—Melvin Jones

(57) ABSTRACT

According to the present invention, an air directing housing is provided for an air conditioning unit of the type having a basepan which supports indoor and outdoor sections. The basepan includes a vertical wall extending upwardly for a part of the height of the unit to define a lower portion of a partition which separates the unit into the indoor and outdoor sections. The indoor section includes an evaporator disposed in the basepan generally forwardly of the partition. A centrifugal fan is mounted between the evaporator coil and the vertical wall for rotation about an axis extending from front to back of the air conditioning unit. The fan is a centrifugal flow fan which has a circular inlet at the front thereof. The air directing housing is adapted to be mounted in the basepan rearwardly of the evaporator coil and surrounding the fan. The housing includes a lower section having a front wall which has a circular opening formed therein which is substantially coextensive with the circular inlet of the fan. The lower section also includes an interior scroll section for receiving the fan, and an open back. The air directing housing further includes an upper section defining an enclosed top structure for cooperation with the upper discharge structure of the lower section to define the air discharge opening of the air conditioner. The upper section further includes a rear wall having a lower edge adapted to engage the vertically extending wall of the basepan to define the upper portion of the partition. As a result, when the lower and upper air directing housing sections are installed in the housing, they cooperate with one another, the basepan, and the vertically extending wall to define the fan housing, the air intake and air discharge of the air conditioner.

3 Claims, 10 Drawing Sheets

AIR DIRECTING ASSEMBLY FOR A ROOM AIR CONDITIONER

TECHNICAL FIELD

The present invention is directed to a room air conditioner and, more particularly, to a room air conditioner having foamed insulation walls forming the evaporator air flow path within the air conditioner.

BACKGROUND ART

Room air conditioners generally have an air inlet and an air outlet at a front side of the air conditioner which faces the interior of the room when the air conditioner is placed in a window opening or in a through-the-wall sleeve. Usually warm air is drawn in through a portion of the front grill to pass through a filter and through the evaporator coil to be cooled and then is directed by a blower or a fan to an outlet also in the front grill.

Prior art air conditioners have included a variety of sheet metal and plastic wall sections for defining the air flow path through such an air conditioner. Also, it is known to use a foamed insulation material to define a portion of the air passage within the air conditioner. U.S. Pat. No. 5,085,057 is representative of such prior arrangements.

Due to the complexity and the number of parts associated with a room air conditioner, assembly of such a device often times includes complicated and time intensive assembly steps and requires intricate manipulation of parts and tools. Such a process results in an increased cost of the room air conditioner due to increased manufacturing costs. Accordingly, it is desirable to design and fabricate components for a window room air conditioner which are as simple as possible and which perform as many functions as possible within the air conditioner while requiring a minimum of cost and labor to install.

DISCLOSURE OF THE INVENTION

According to the present invention, an air directing housing is provided for an air conditioning unit of the type having a basepan which supports indoor and outdoor sections. The basepan includes a vertical wall extending upwardly for a part of the height of the unit to define a lower portion of a partition which separates the unit into the indoor and outdoor sections. The indoor section includes an evaporator disposed in the basepan generally forwardly of the partition. A centrifugal fan is mounted between the evaporator coil and the vertical wall for rotation about an axis extending from front to back of the air conditioning unit. The fan is a centrifugal flow fan which has a circular inlet at the front thereof. The air directing housing is adapted to be mounted in the basepan rearwardly of the evaporator coil and surrounding the fan. The housing includes a lower section having a front wall which has a circular opening formed therein which is substantially coextensive with the circular inlet of the fan. The lower section also includes an interior scroll section for receiving the fan, and an open back. The air directing housing further includes an upper section defining an enclosed top structure for cooperation with the upper discharge structure of the lower section to define the air discharge opening of the air conditioner. The upper section further includes a rear wall having a lower edge adapted to engage the vertically extending wall of the basepan to define the upper portion of the partition. As a result, when the lower and upper air directing housing sections are installed in the housing, they cooperate with one another, the basepan, and the vertically extending wall to define the fan housing, the air intake and air discharge of the air conditioner.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
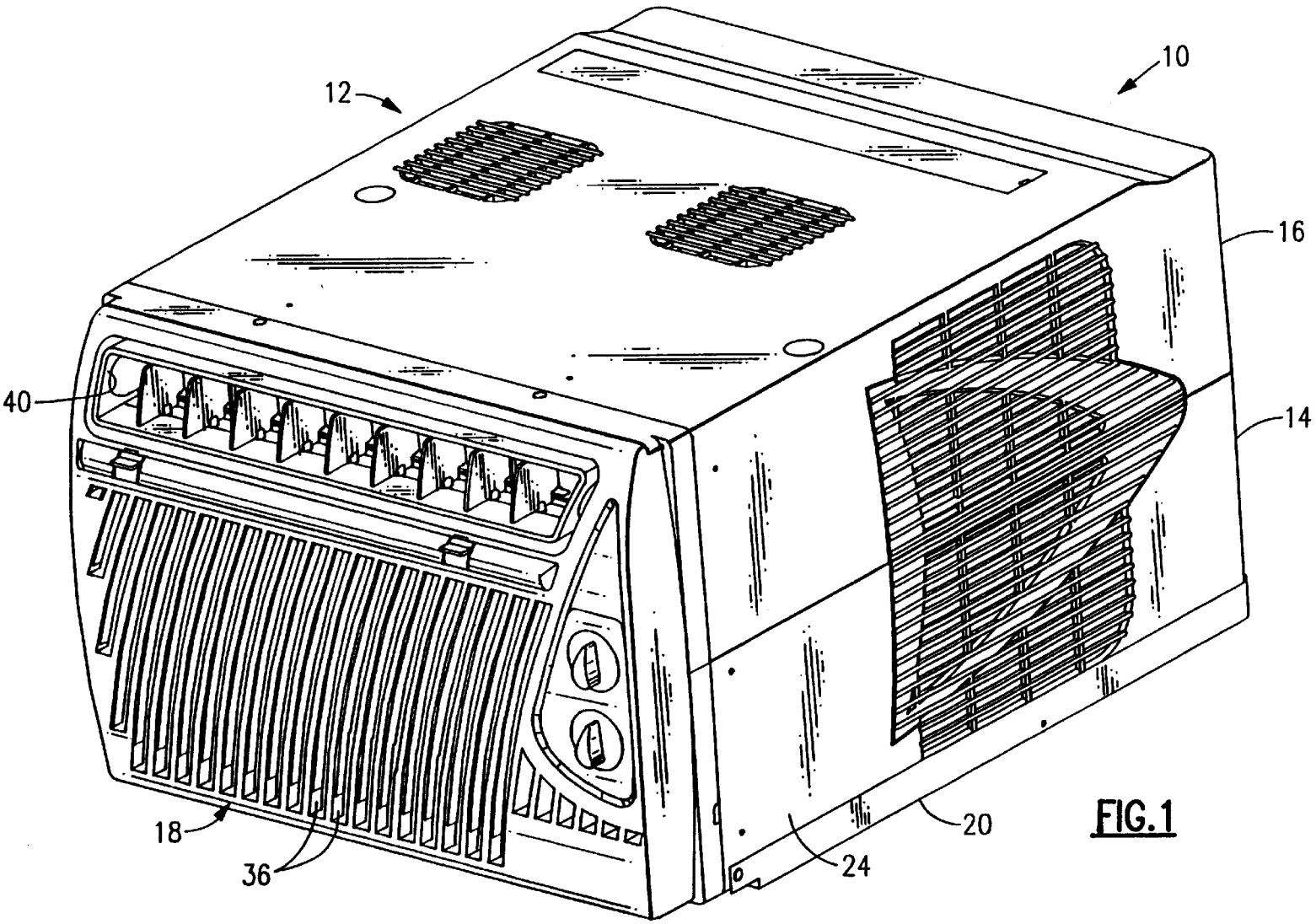
FIG. 1 is an perspective view of a room air conditioner which embodies the features of this invention.
Figure 2:
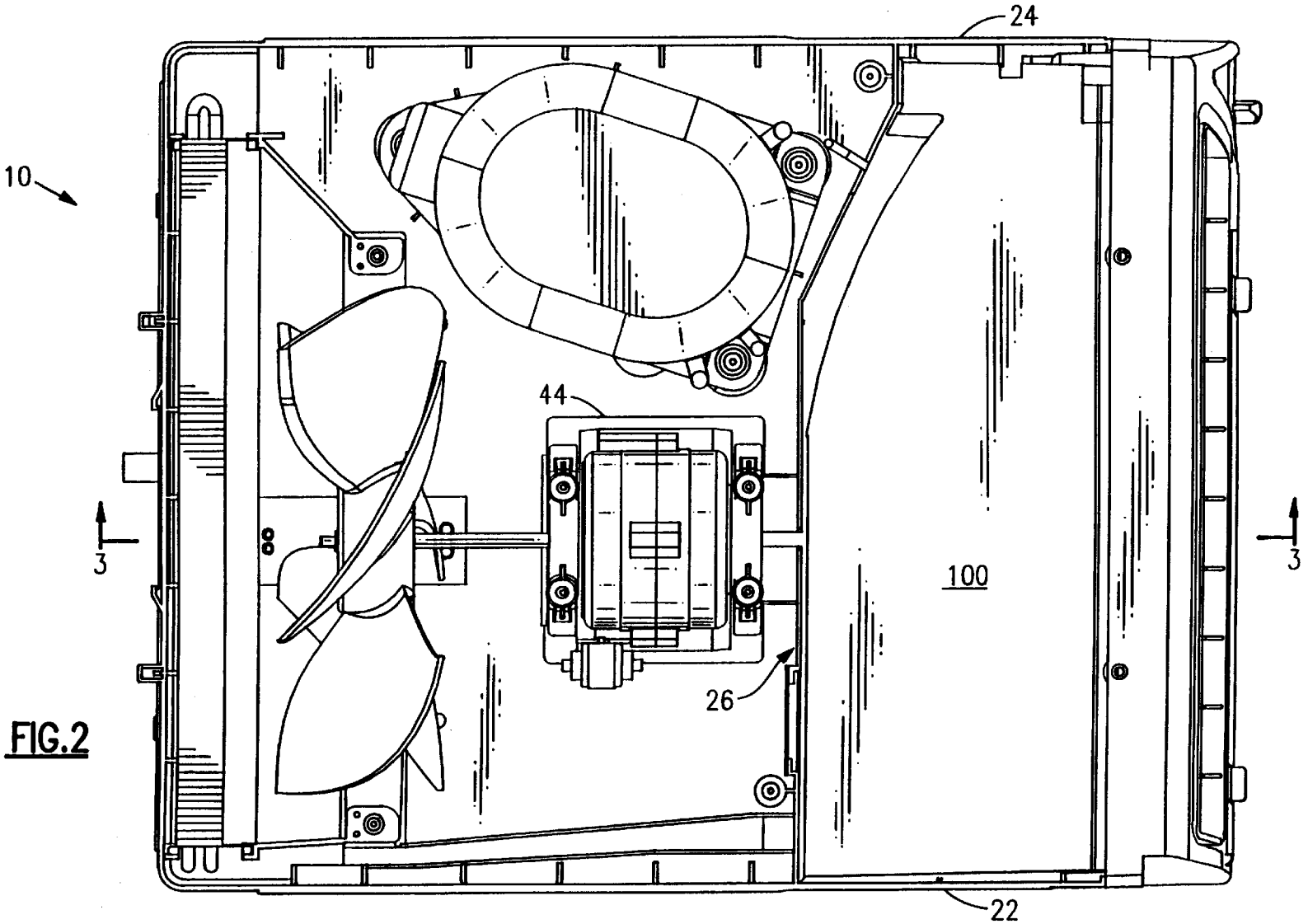
FIG. 2 is a top plan view of the air conditioner of FIG. 1 with the upper housing removed therefrom.

With reference initially to FIG. 1, a room air conditioner 10 includes a substantially rectangular housing 12 which includes a lower housing section 14, an upper housing section 16, and an indoor grill section 18. The lower housing section 14 is mounted in a metal basepan 20 and the entire room air conditioner is adapted to be positioned in a rectangular opening in an exterior wall or on a windowsill in a room where cooling is desired with the indoor grill section 18 facing into the room, as is conventional.

The housing sections 12 and 14 and the grill 18 are preferably made from a molded plastic material. As best seen in FIGS. 2 through 5, the entire air conditioning unit 10 is supported on a plastic basepan 21 molded integrally with and forming the bottom of the lower housing 14. Extending upwardly from the basepan, and integrally formed with left and right side walls 22 and 24, respectively, is a vertically extending partition 26 which separates the lower housing 14 into an indoor section 28 and an outdoor section 30.

Figure 3:
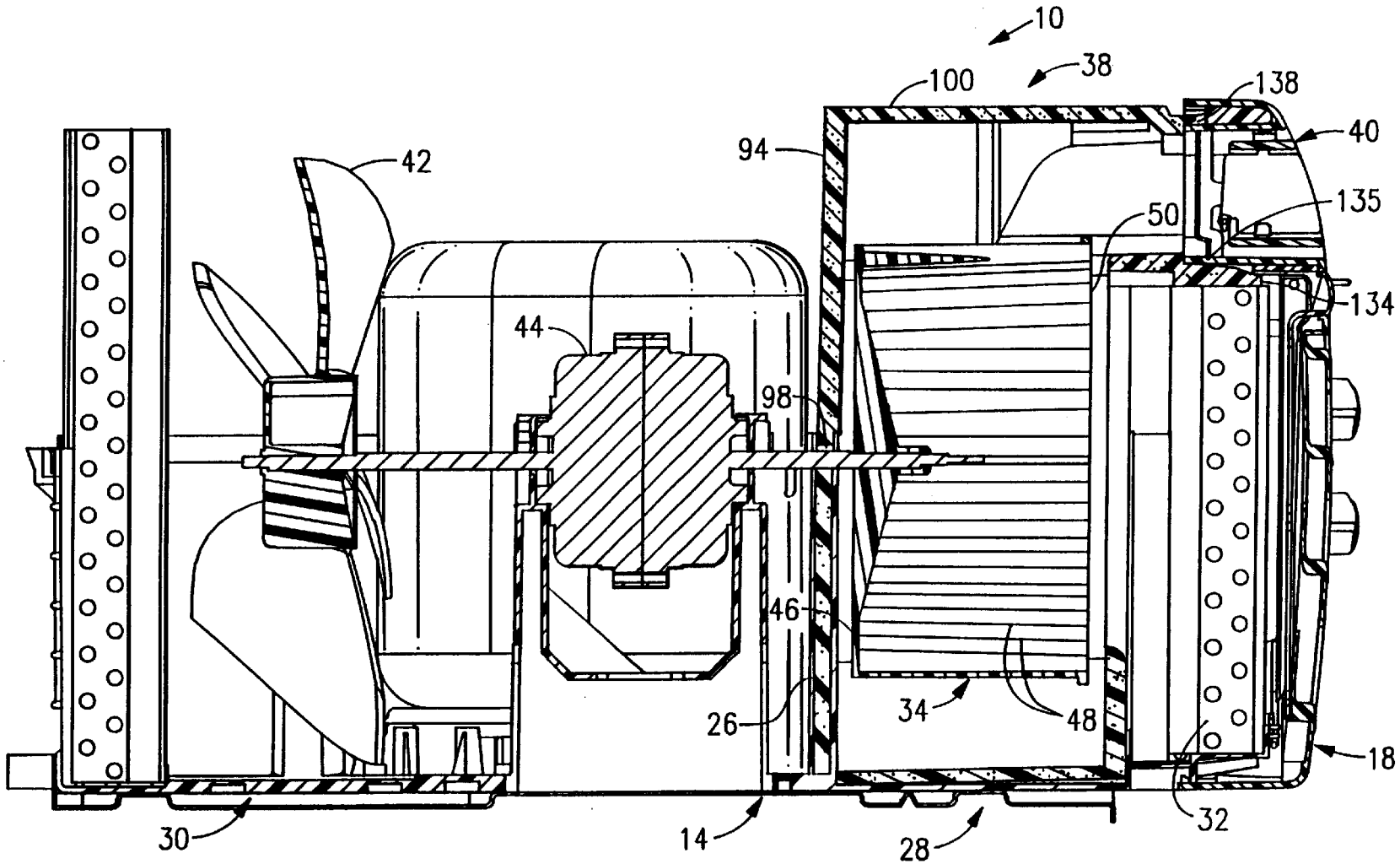
FIG. 3 is a view taken along the line 3—3 of FIG. 2.

As best seen in FIG. 3, the air conditioning unit includes an indoor refrigerant-to-air heat exchanger 32 (hereinafter "evaporator coil") and an inside or evaporator fan 34. Briefly, air from the space to be conditioned by the system is drawn by action of the evaporator fan 34 through inlet louvers 36 formed in the indoor grill section 18 and is directed through the evaporator coil 32 where the air is cooled. The cooled air is then directed back into the space to be cooled by an air directing housing 38, which, in turn, directs the air through an indoor conditioned air discharge opening 40 forming part of the grill 18. As is best seen in FIG. 3, both the evaporator fan 34 and an outdoor or condenser fan 42 are driven from opposite ends of a single drive shaft of a common drive motor 44 mounted in the outdoor section 30.

Other components of the air conditioner forming the outdoor section 30 of the air conditioning unit are not necessary to an understanding of the present invention and will not be described herein.

With continued reference to FIG. 3, the indoor fan 34 is a centrifugal fan mounted for rotation about an axis extending from the front to back of the air conditioning unit 10. The fan has a closed back wall 46 and a plurality of longitudinally extending blades 48 defining the outer periphery thereof, and a circular inlet at the front 50 thereof. The fan is configured such that upon rotation in a clockwise direction, as viewed from the front of the unit, air will be drawn into the opening in the front thereof and directed radially outwardly therefrom.

The air directing housing 38 includes a lower section 52 and an upper section 54. As will be seen, the upper section 54 and lower section 52 cooperate to define a structure which in turn cooperates with the separating partition 26 to house the evaporator fan 34, the define the air directing scroll associated with the fan 34, and to define the air passage which directs discharge air to the air discharge assembly 40 of the grill 18.

The lower section 52 of the air directing housing comprises a lower base section 56 which is adapted to be received in a space 58 defined in part by the bottom wall of the basepan 21 and a pair of spaced positioning walls 60 integrally formed with the base and adapted to engage opposite ends 62 of the lower base section 56. The space 58 is further defined at the front by a wall 61 extending between the spaced walls 60 and in the rear by the partition wall 26. The lower section 52 comprises a substantially planar front wall 64 which has a circular opening 66 formed therein which is adapted to be in coextensive fluid flow relationship with the inlet to the indoor fan 34 when the unit is assembled. The sizing of the circular opening is preferably slightly smaller than the inlet opening to the fan to minimize air leakage from the outer discharge side of the fan therethrough.

Substantially planar left and right-hand side walls 68 and 70, respectively, are integrally formed with the base 56 and front wall 64 of the lower section 52. The intersection of the left side wall 68 with the front wall 64 defines the left front corner 72, likewise the intersection of the right side wall 70 with the front wall 64 defines the right front comer 74. The back of the lower section 52 is substantially open and defines an outer perimeter wall 76.

Figure 4:
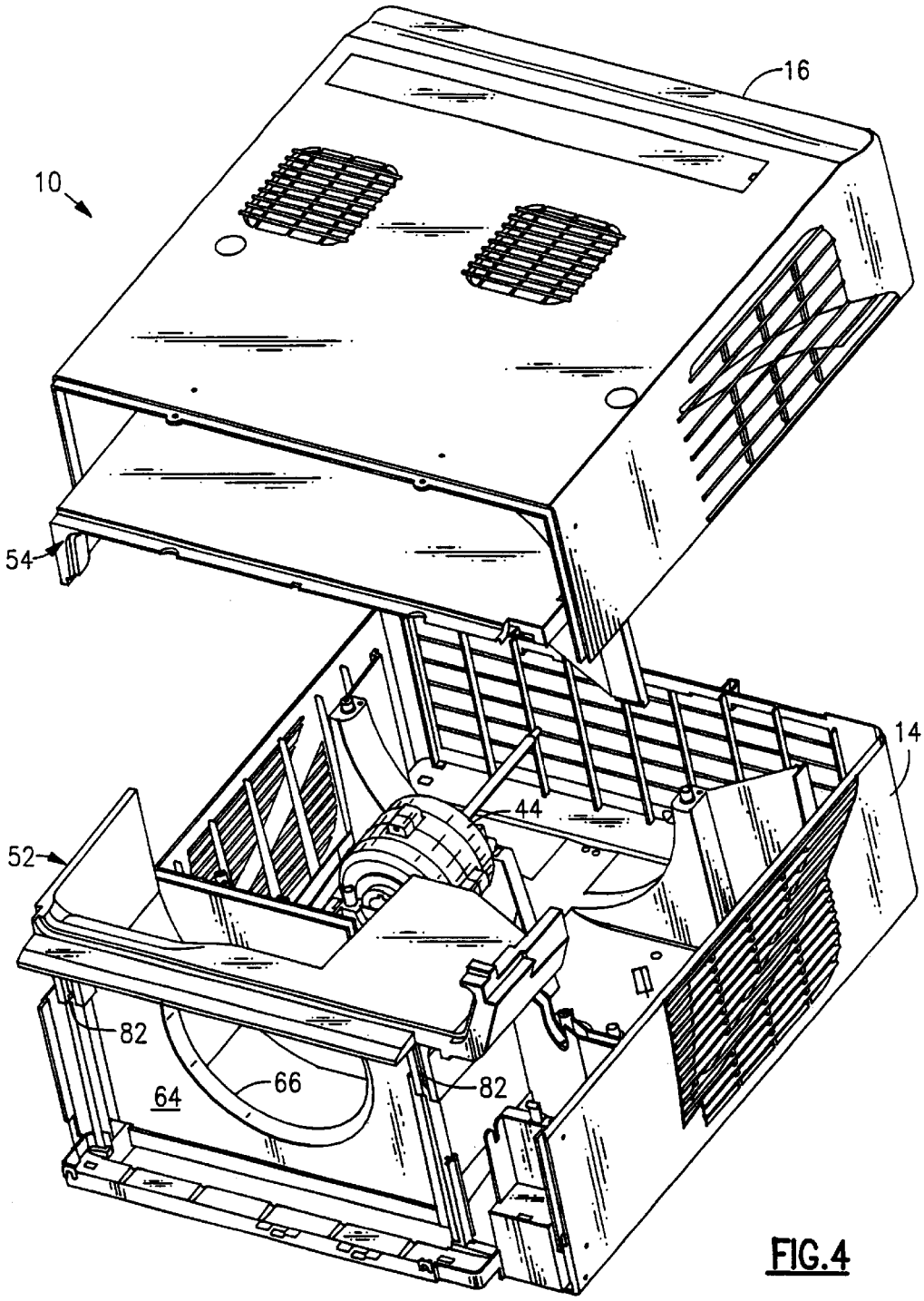
FIG. 4 is a partially exploded perspective view of the air conditioner of FIG. 1 with a number of the components removed therefrom.
Figure 5:
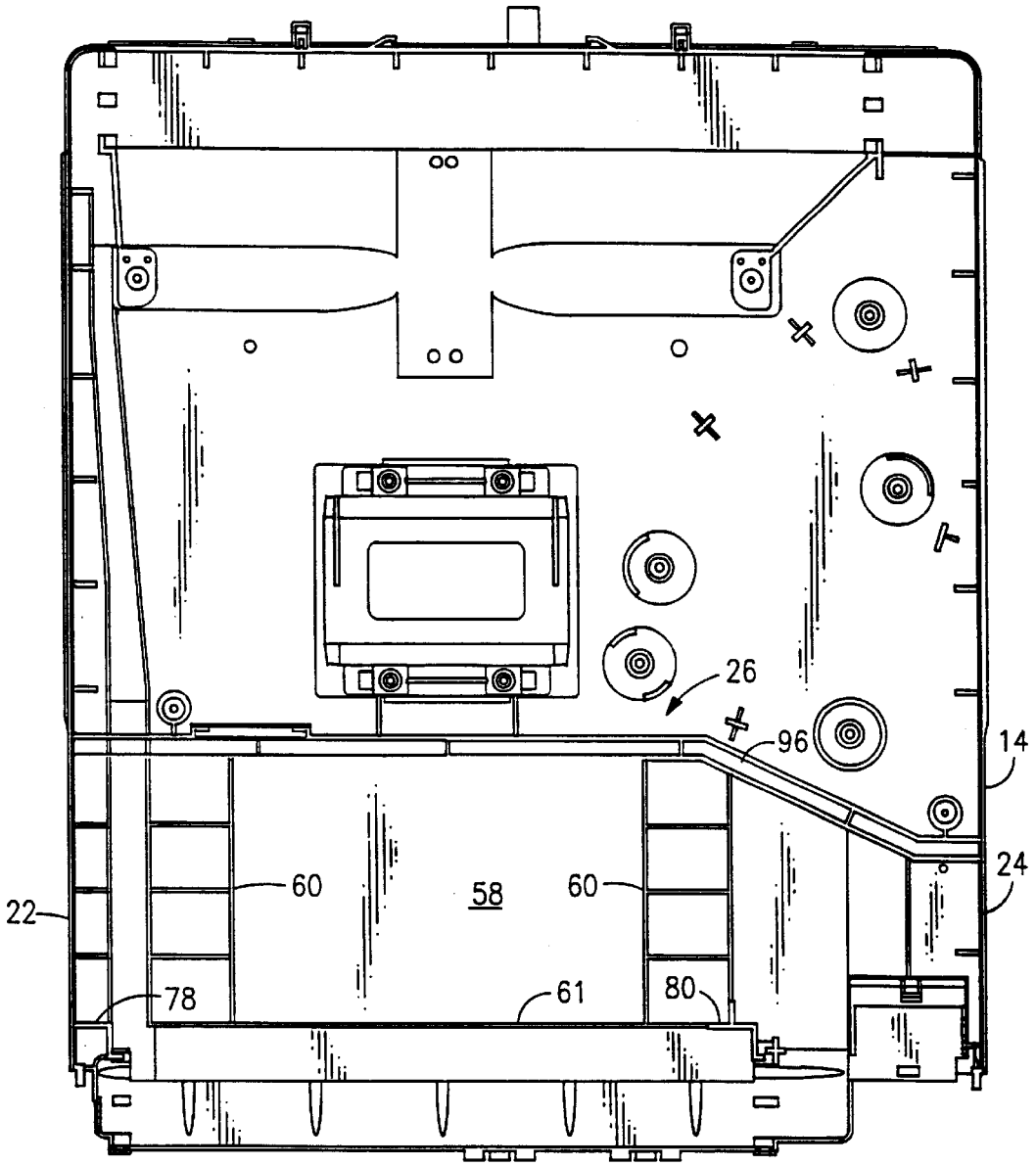
FIG. 5 is top plan view of the air conditioner of FIG. 1 with most of the components removed therefrom.

Support and positioning of the lower housing section 52 is provided by engaging the lower base section 56 with the previously described side and front wall sections 60 and by engagement of the left and right front comers 72 and 74, respectively, with vertically extending angular support and guide channels 78 and 80 which are best seen in FIGS. 4 and 5. The support channels 78 and 80 are each integrally formed with the lower housing section 14 and extend vertically to an elevation just below a pair of evaporator support channels 82 formed in the front wall 64 at the lower section 52. The back wall 76 of the lower section 52 engages the partition 26 as best seen in FIG. 4 and the lower part of the front wall 64 engages the wall 61. In order to assure an air tight contact between the back wall 76 and the partition, the front wall 64 is provided with vertically extending raised sections 84 on opposite sides thereof, adjacent the left 72 and right 4 comers which assures an interference fit between the front wall 64 acting through the raised sections 84 and the rear wall with the partition 26.

Figure 12:
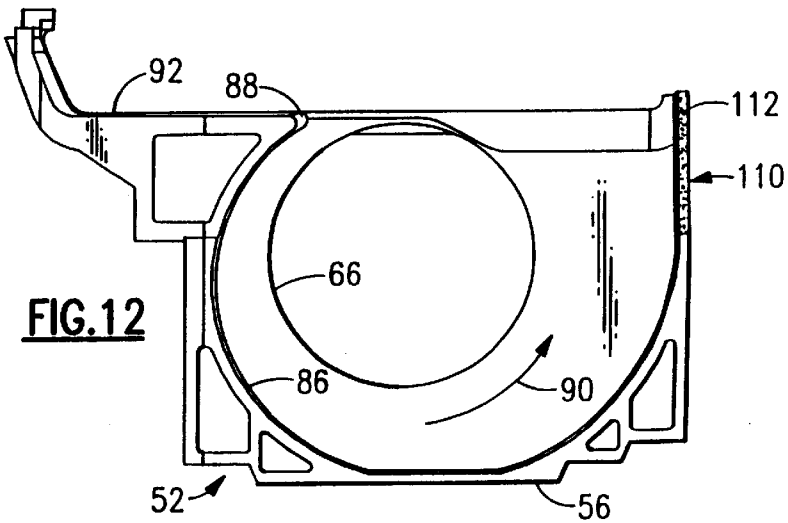
FIG. 12 is a rear view of the lower section of the air directing housing.
Figure 9:
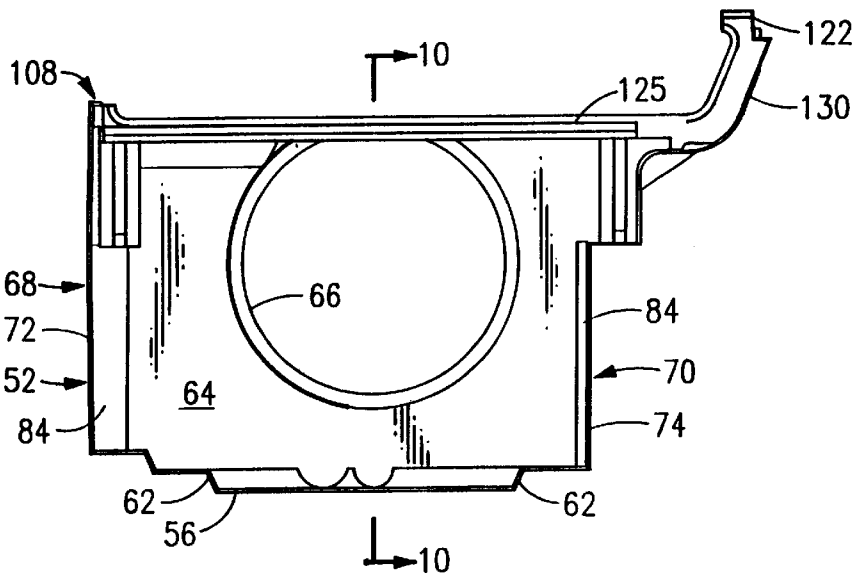
FIG. 9 is a front view of the lower section of the air directing housing.
Figure 11:
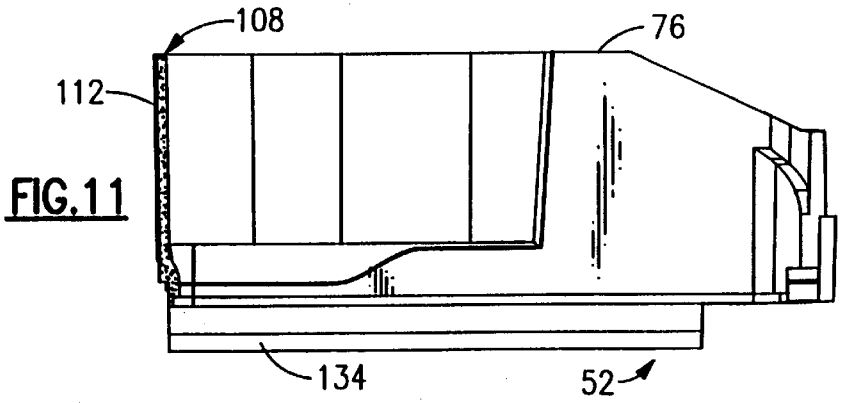
FIG. 11 is a top view of the lower section illustrated in FIG. 9.

The interior of the lower section 52 comprises a substantially circular chamber defined by a circular wall 86. The circular wall 86 is eccentrically located with respect to the circular opening 66 in the front wall such that when the fan 34 is mounted coaxially with the opening 66, the fan scroll is defined from a region extending from a sharp wall 88, in close proximity to the fan, in a counterclockwise direction (as viewed in FIG. 12), to an increasingly larger cross-section as the air flows upwardly as represented by arrow "90". As will be seen, the part of the lower section 52 which extends above the top wall 92 cooperates with the upper section 54 to complete the air passage through the air conditioning unit.

Figure 7:
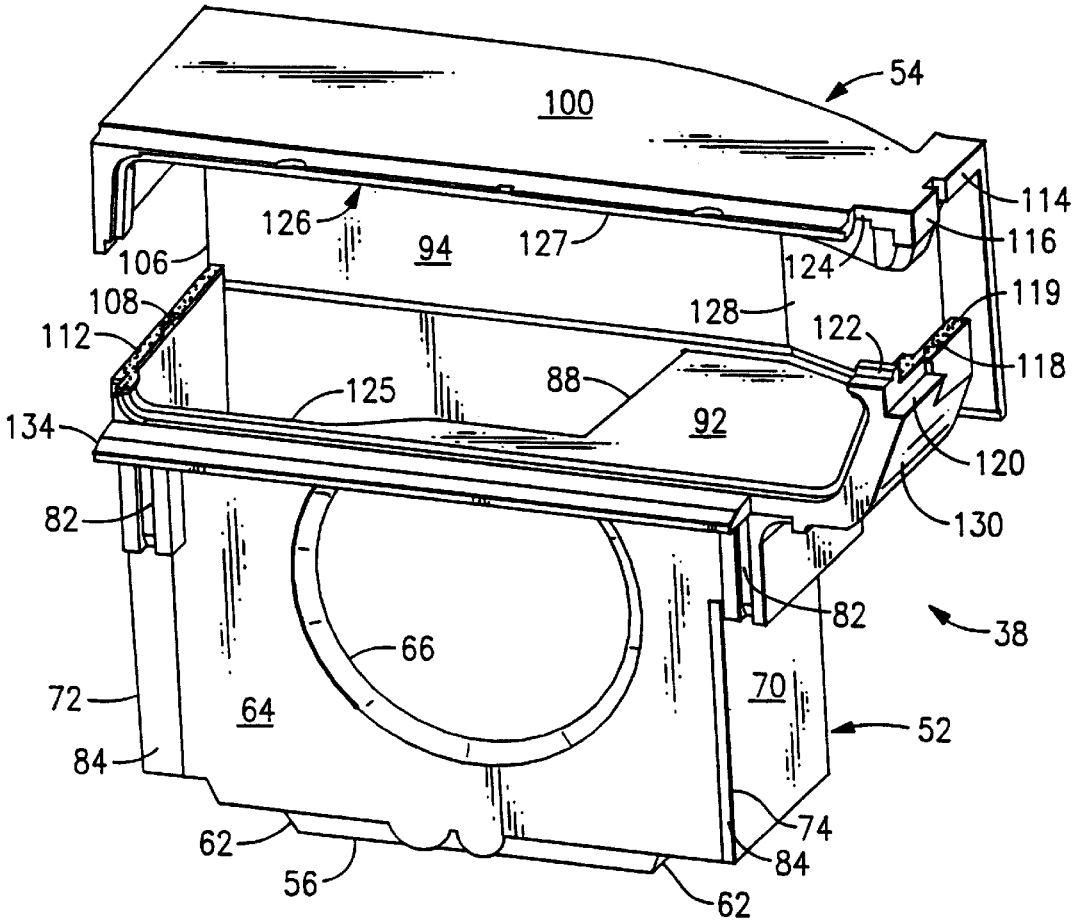
FIG. 7 is a view similar to FIG. 6 showing the two sections of the air directing housing separated from one another.
Figure 8:
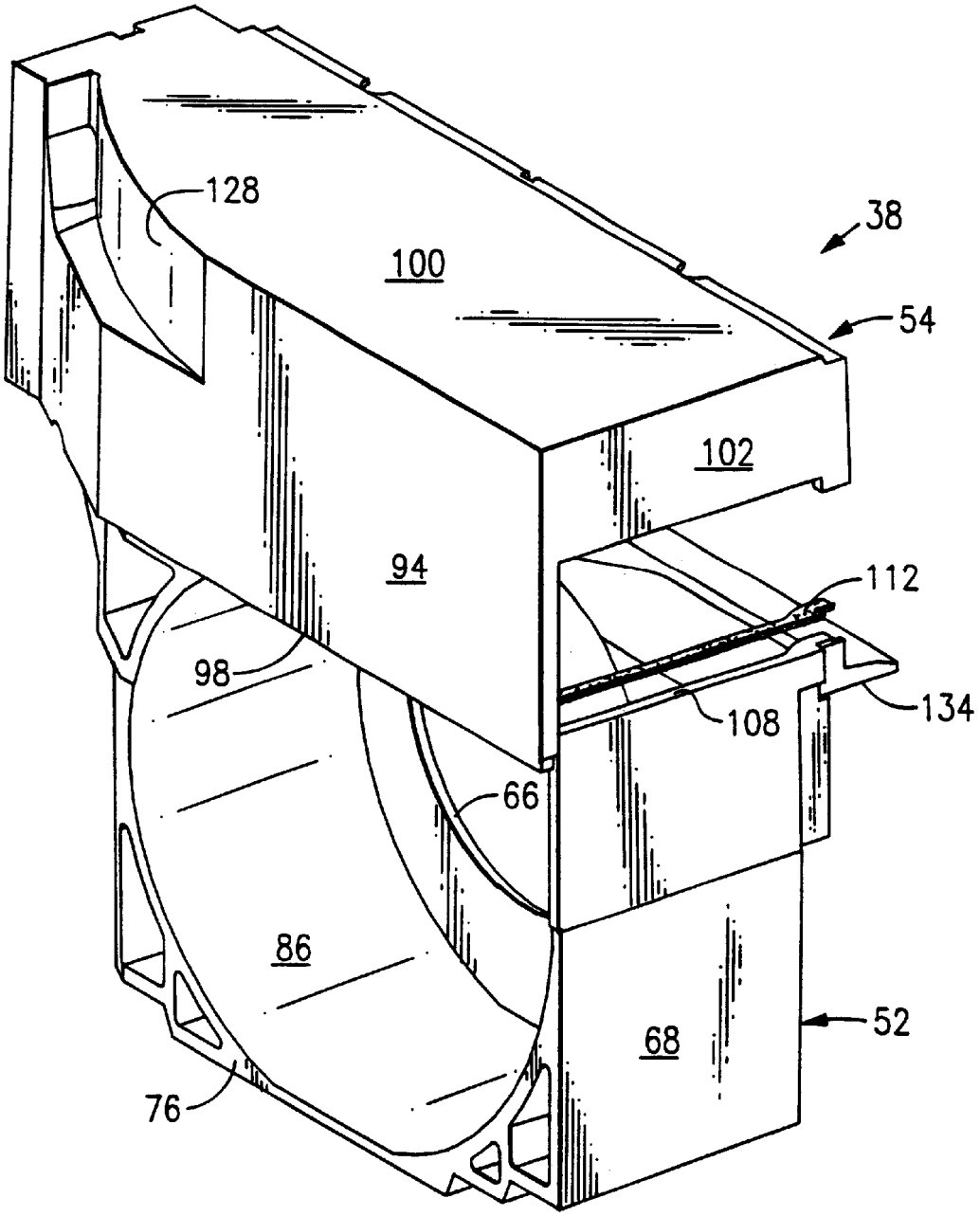
FIG. 8 is a rear perspective view similar to that of FIG. 7.
Figure 10:
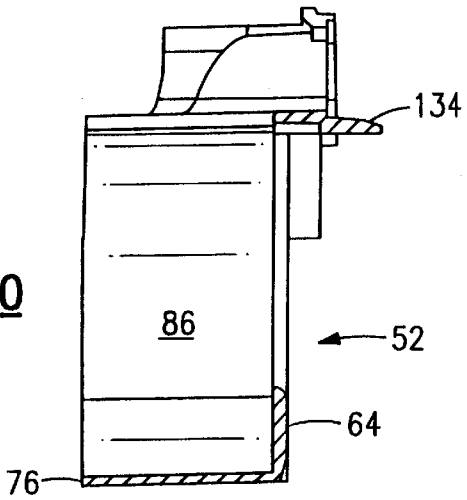
FIG. 10 is a view taken along the line 10—10 of FIG. 9.

Looking now at the upper section 54 of the air directing housing 38. The upper section 54 comprises a back wall 94 which has the same shape as the partition wall 26 between the indoor section 28 and outdoor section 30. It will be noted with reference to FIG. 5 that the partition 26 is defined by a pair of spaced wall sections defining an interior space 96 therebetween. The lower end 98 of the rear wall 94 defines a section of reduced thickness which is adapted to be received within the space 96 in the partition wall 26 to thereby define an air tight seal therebetween. The upper section 54 further comprises a substantially planar top 100 and a left-hand downwardly extending wall section 102. With reference to FIGS. 7 and 8, a downwardly facing surface 104 on the left-hand wall section 102 and a forwardly facing portion 106 of the rear wall 94 are adapted to engage mating wall sections 108 and 110, respectively, on the lower housing section 52. These surfaces are preferably provided with a gasket-like material 112 to assure an air tight fit therebetween.

Figure 6:
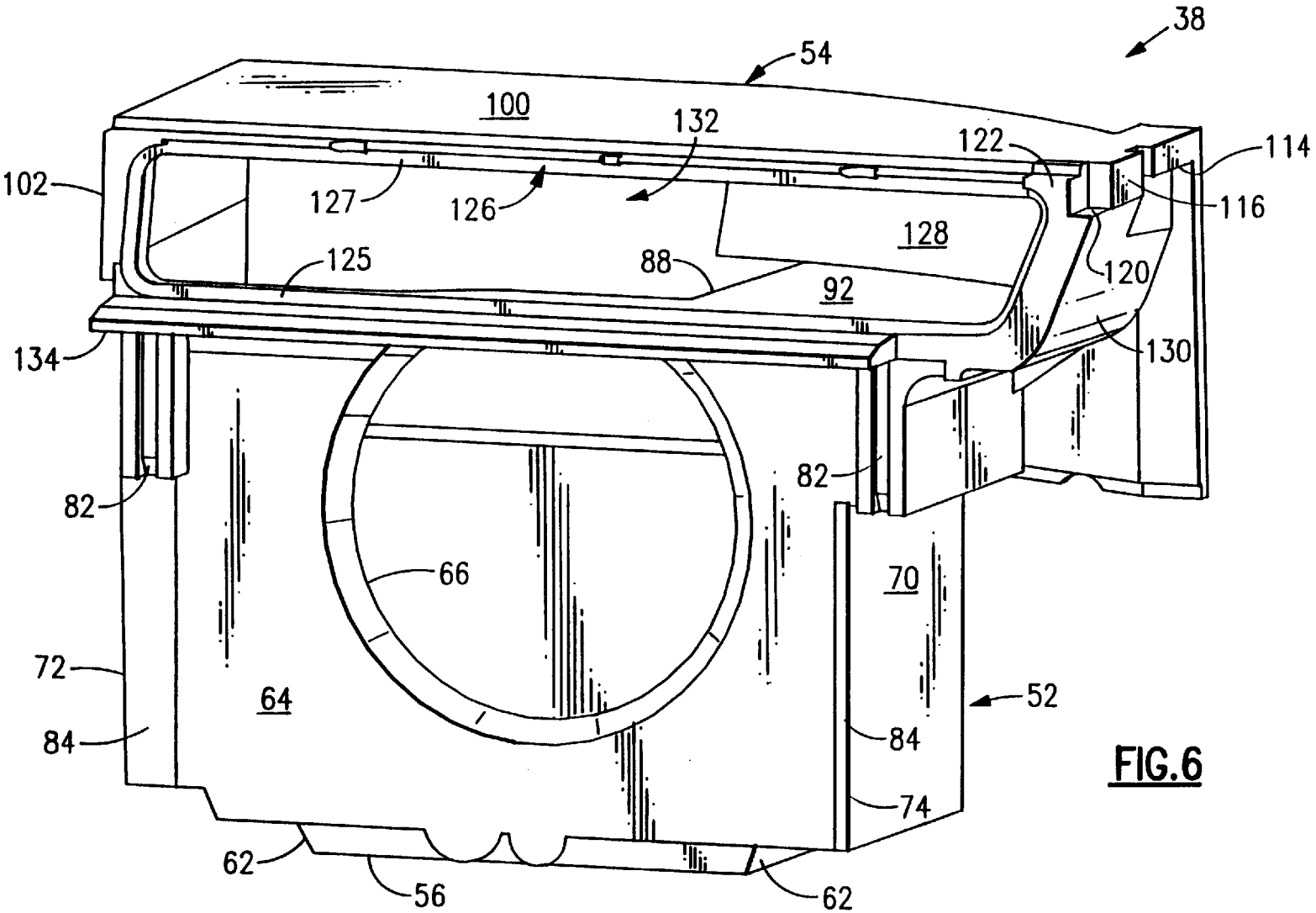
FIG. 6 is a perspective view of the air directing housing of the present invention removed from the air conditioning unit.
Figure 14:
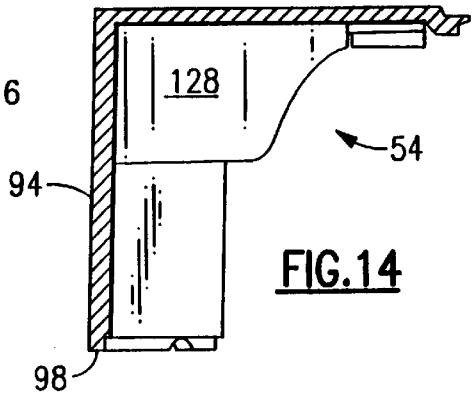
FIG. 14 is a view taken along the line 14—14 of FIG. 13.
Figure 16:
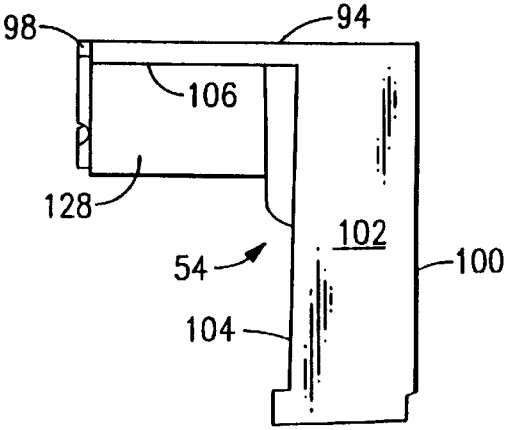
FIG. 16 is an left-hand end view of the upper section of the air directing housing as illustrated in FIG. 15.
Figure 13:
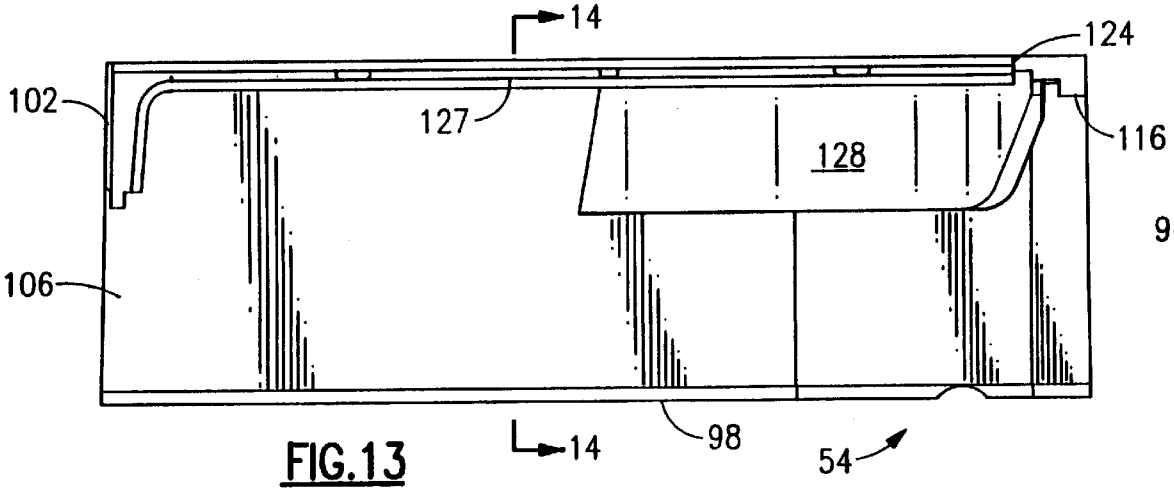
FIG. 13 is a front view of the upper section of the air directing housing.
Figure 15:
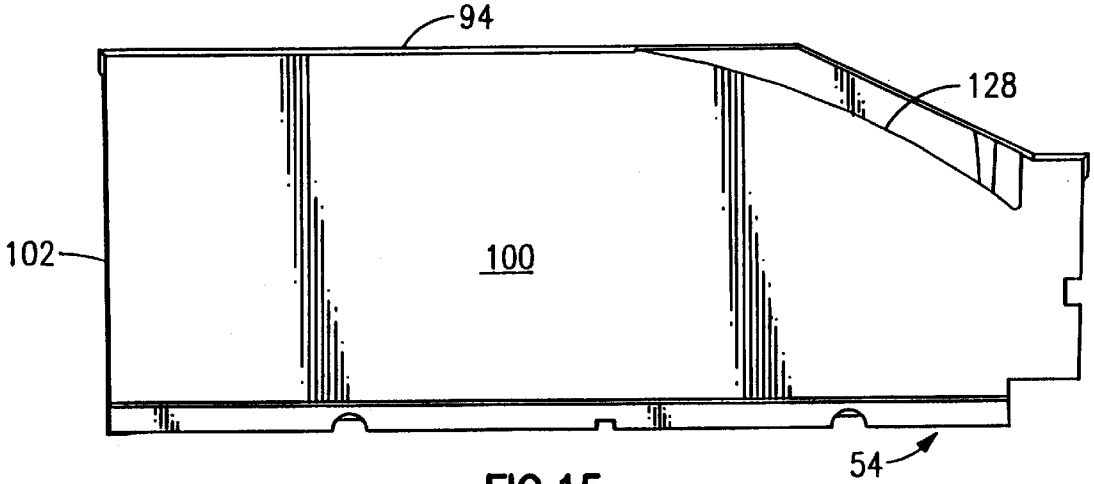
FIG. 15 is a top view of the upper section of the air directing housing.

As best appreciated from FIGS. 6, 7 and 14, the right-hand end of the upper section 54 is provided with a downwardly facing surface 114 and a downwardly extending positioning lug 116. The downwardly extending surface 114 is adapted to engage a mating surface 118 provided on the upper right-hand end of the lower section 54. Likewise, the downwardly extending positioning lug 116 is adapted to be received in a mating notch 120 defined on the upper right-hand end of the lower section 52. Further alignment between the upper and lower sections is achieved by engagement of a vertical extension 122 on the right-hand side of the lower housing section 52 with a mating notch 124 formed in the right-hand end of the upper housing section 54. One of the surfaces 114 or 118 is provided with a suitable gasket-like material 119 to assure an air tight contact therebetween.

Looking now at FIGS. 6 and 7, the upper end of the housing section 52 is provided with an elongated open front defined by a "sideways L" shaped perimeter wall 125. Likewise, the front of the upper housing section 54 is provided with an elongated opening defined by a "sideways L" shaped perimeter wall 127. As best seen in FIG. 6, with the upper and lower housing sections 54 and 52 assembled to one another, the perimeter walls 125 and 127 cooperate to define an air discharge opening 126 from the air directing housing 38.

It will be further appreciated that the right-hand portion of the rear wall 94 of the upper section 52 is provided with a curved section 128 which is adapted to cooperate with the top wall 92 of the lower section 52 and a side wall portion 130 of the lower housing section 52 which extends the end of the "L shaped" wall 125. The cooperation of these walls defines an interior plenum 132 which directs air to the air discharge opening 126.

With particular reference to FIG. 3, and the other drawing figures, it will be noted that the lower section of the scroll 52 is further provided with an elongated outwardly extending wall section 134 which is adapted to overly the top of the evaporator coil 32 when the upper scroll is installed in the air conditioning unit. Again, as best seen in FIG. 3, when the indoor grill 18 is installed to the air conditioning unit, a lower wall 135 forming part of the air discharge opening 40 engages the top of the wall 134. Further, additional wall sections of the air discharge opening 40 defines a rear peripherally extending wall 138 which is adapted to engage a peripheral mating surface 140 defined by the air discharge opening 126 formed by to the upper and lower sections 54 and 52 of the air directing housing 38. It will be noted that portions of the air discharge opening 126 are configured to extend in overlapping relationship with the wall 138 in order to define a substantially air tight seal therebetween.

Accordingly, it should be appreciated that the air directing housing 38 formed by the lower section 52 and the upper section 54 cooperate with one another and the partition wall to define the fan housing, the air intake and air discharge of the air conditioner.

What is claimed is:

1. An air conditioning unit of the type having a base pan which supports indoor and outdoor sections, said basepan including a vertical wall extending upwardly for a part of the height of said unit to define a lower portion of a partition defining the unit into said indoor and outdoor section, said indoor section comprising:

an evaporator coil disposed in said basepan generally forward of said partition;

a centrifugal fan mounted between said evaporator coil and said vertical wall for rotation about an axis extending from the front to back of said air conditioning unit, said fan comprising a closed backside, a plurality of longitudinally blades defining the outer periphery thereof, and a circular inlet at the front thereof;

an air directing housing adapted to be mounted in said basepan rearwardly of said evaporator coil and surrounding said fan, said housing comprising:

a lower section having a front wall which has an opening formed therein located substantially coextensive with said circular inlet of said fan, an upper air discharge structure, an interior scroll section for receiving said fan, and an open back; and an upper section comprising an enclosed top structure for cooperation with said upper discharge structure of said lower section to define an air discharge opening of said air directing housing, and a rear wall having a lower edge adapted to engage said vertically extending wall of said basepan to define the upper portion of said partition;

whereby when said lower and upper air directing housing sections are installed in said housing, they cooperate with one another, and said vertically extending wall to define the air intake and discharge of said air conditioner.

2. The apparatus of claim 1 wherein said air directing housing is made from a plastic foam material.

3. The apparatus of claim 1 wherein said air conditioning unit further includes air indoor grill, said indoor grill having an air discharge opening therein, said air discharge opening defining a rearwardly extending peripheral wall, said peripheral wall being adapted to engage said air discharge opening of said air directing housing in an air tight relationship.

* * * * *